United States Patent [19]

Johannes

[11] Patent Number: 4,960,206

[45] Date of Patent: Oct. 2, 1990

[54] SYSTEM FOR PACKAGING A PRODUCT AND FOREWARNING CONSUMERS IF THE PACKAGE HAS BEEN TAMPERED WITH

[75] Inventor: Wayne N. Johannes, Madison, Wis.

[73] Assignee: Vac-Puff Corporation, Madison, Wis.

[21] Appl. No.: 920,150

[22] Filed: Oct. 17, 1986

Related U.S. Application Data

[63] Continuation-in-part of Ser. No. 856,227, Apr. 28, 1986, abandoned.

[51] Int. Cl.[5] ..... B65D 73/00

[52] U.S. Cl. ..... 206/459; 206/807; 215/307; 215/366; 220/271; 220/361; 220/420

[58] Field of Search ..... 206/528, 807, 524.8, 206/502; 116/70, 137 R; 220/270, 271, DIG. 16, 420, 425, 361, 368, 371, 373; 215/250, 252, 256, 270, 307, 310, 360, 366, 367, 206; 383/5, 100, 103

[56] References Cited

U.S. PATENT DOCUMENTS

| | | | |
|---|---|---|---|
| 1,651,655 | 12/1927 | Wright et al. | 220/425 |
| 2,823,822 | 2/1958 | Altman | 220/425 |
| 3,187,933 | 6/1965 | Cheeley | 220/271 |
| 3,229,478 | 1/1966 | Alonso | 220/425 X |
| 3,371,811 | 3/1968 | McKnight | 215/307 X |
| 3,685,679 | 8/1972 | Heffran | 220/270 X |
| 4,398,491 | 8/1983 | Fridl et al. | 220/231 X |
| 4,434,893 | 3/1984 | Barlow | 206/522 |
| 4,436,203 | 3/1984 | Reyner | 206/524.8 |
| 4,449,632 | 5/1984 | Marusiak, Jr. | 206/524.8 X |
| 4,462,504 | 7/1984 | Roth et al. | 220/214 |
| 4,548,824 | 10/1985 | Mitchell et al. | 220/367 X |
| 4,813,541 | 3/1989 | Velasco et al. | 206/459 |

FOREIGN PATENT DOCUMENTS

| | | | |
|---|---|---|---|
| 2217325 | 2/1973 | Fed. Rep. of Germany | 215/310 |

*Primary Examiner*—Bryon P. Gehman

*Attorney, Agent, or Firm*—Foley & Lardner

[57] ABSTRACT

A packaging system includes a container having a closure therefore. A vacuum or gas pressure is provided within the container during the packaging process. The container also includes an aperture and a sealing member for the aperture, the latter being designed so that an audible puff of air can be noticed by the consumer when the sealing member is removed from the aperture. The system of the present invention may include a separate package sealing lid or a child-proof lid selected from a variety of such lids known to the art. Unlike prior art packaging systems which claim to be "tamper-proof," the system of the present invention provides an audible warning sound which will forewarn the consumer if package tampering or a package manufacturing failure has occurred. Inner liner or double container systems using a similar aperture and sealing system are also disclosed.

7 Claims, 3 Drawing Sheets

SYSTEM FOR PACKAGING A PRODUCT AND FOREWARNING CONSUMERS IF THE PACKAGE HAS BEEN TAMPERED WITH

CROSS REFERENCES TO RELATED APPLICATIONS, IF ANY:

This application is a continuation-in-part of U.S. Pat. application Ser. No. 856,227, filed Apr. 28, 1986, now abandoned and commonly assigned to the assignee hereof.

BACKGROUND OF THE INVENTION

1. Field Of The Present Invention:

The present invention relates generally to the art of packaging, and more specifically, it relates to the art of packaging products in a manner in which the consumer of the product will be forewarned if tampering of the product has taken place through the package or if a package manufacturing failure has occurred.

2. Description Of The Prior Art:

The tampering of various products, especially pharmaceutical products, has become of national and international concern in recent years. Capsules which have been filled with cyanide have led to the deaths of numerous individuals in the United States, and many companies have eliminated capsules from the distribution chain as a form of dispensing medication. Threats by terrorist groups and the seemingly ever increasing number of dangerously homicidal individuals is causing fear among consumers and concern and expense to the companies which manufacture and sell products to consumers.

While most incidents reported to date relate to pharmaceutical products and capsules in particular, other medications in liquids, tablet and caplet form are also susceptible to being contaminated by small quantities of toxins. For example, tablets could easily be contaminated by drilling out a portion of the tablet and replacing it with a toxin. Liquid medications, could be mixed directly with the toxin. Moreover, the problem is not limited to pharmaceutical products, in that tampering with food or beverage products is likely to become more prevalent as more of these heinous crimes are committed.

Companies which manufacture and sell pharmaceutical and food and beverages products are taking steps to make tampering with the product more difficult. For example, many over-the-counter drugs and medications are now sold in containers which have a heat sealed foil closure which must be removed prior to use of the product. As of 1986, at least three deaths have occurred due to contamination of a product contained in a heat-sealed foil closure. Other medications are sold in packages which include a pull-ring system and a metal disc as a closure system for the package, the top including a score line designed so that the top may be torn away after the ring has been lifted. Other techniques include the packaging of products in cellophane or other plastic wrapping, the insertion of a regular container of medication into a separate outer container having a pull-off top, etc.

While the industry is now proclaiming that such packaging systems are "tamper proof", the fact is that the contents of such systems could easily be contaminated without opening the top of the container. Such advertising is misleading in view of the sophistication likely to be encountered from terrorist groups and others. For example, it is possible to drill a small hole through the side of the container and insert the contaminating toxin with a hypodermic needle. The drill hole could easily be disguised by someone having only minimal tools and sophistication in such matters. All prior art attempts known to the present inventor involve attempts to prevent tampering with the package (which the present inventor believes to be impossible), rather than the development of a packaging system which would warn the consumer prior to use if the package has been tampered with or, as is sometimes the case, the product has not been properly packaged.

Before proceeding to a description of certain patents which show packaging systems of the type described above, it should be mentioned here that numerous types of "child-proof" packages are now on the market. These devices are designed to prevent young children from gaining access to the contents of a container and include such well known systems as the lip and gap system in which arrows must be aligned to allow the container to be opened, or the type of system used by many druggists in which the container closure must be pushed downwardly and turned to gain access to the container's contents. Numerous other child-proof systems are in common use today, and no claim is made by the present inventor that, in and of itself, the use of child-proof systems are unique.

It should also be mentioned prior to a discussion of certain patents that prior to the advent of modern can-openers, especially electric can-openers, certain food products were sold with a tab and key opening system. For example, coffee has been sold in cans which were scored in such a manner that a strip could be wound around a key (typically provided on the top of the can) to release a vacuum within the can and separate the top of the can from the body of the container. Coffee companies advertised that the vacuum released by the opening of the can provided an indication of product freshness.

In U.S. Pat. No. 2,998,158, issued Aug. 29, 1961 for "Severable Sealing Means For Reusable Packages", Tupper discloses a "tamper resistant" container for a variety of products, including pharmaceuticals. The patent discloses a plastic, snap fit lid having a horizontal flange, the lid being designed to be placed over a container having an upstanding portion to be engaged by a snap fit ring and a horizontal flange below such portion. The mating flanges of the lid and container are thermally or adhesively bonded together and score lines are provided in each flange. A weak connection is thereby provided between the inner and outer sections of the flanges. A notch is also provided at one location along the mating flanges, so that the consumer can tear away the outer portion of the flanges which have been welded together. Access to the container is provided by deforming the lid or the container and pushing the lid off the container. The container and the lid are described as being reusable.

In Wheeler's U.S. Pat. No. 4,043,475 issued Aug. 23, 1977 for "Caps and Containers", a closure assembly is described as being both "tamper-proof" and child resistant. The closure and the container include two beads, over which the closure is press-fitted during packaging. A lower bead on the cap seals against the container, that bead being a portion of a tear strip located between the first and the second beads of the container. After the tear strip is removed, a lug and gap child-resistant closure is provided. As mentioned previously, neither this patent, nor the Tupper patent are, in fact, "tamper-proof" in that the product could be contaminated through the container itself. Neither patent discloses any system for warning the consumer if tampering or a package manufacturing failure has occurred.

Another system involving a tear strip is described in U.S. Pat. No. 4,103,803 issued Aug. 1, 1978 to Irvine for "Tamperproof Container And Cap Assembly". In the device described here, a container has a radially extending flange which cooperates with a skirt of the cap to prevent the cap from being removed until a portion of the cap skirt is removed. This patent differs from other simple tear strip designs in that the two ends of the tear strip are connected by a frangible membrane which must be ruptured by a tool before a pull tab becomes accessible. This patent also does not disclose a truly "tamper-proof" container or provide any warning to consumers that tampering or a package manufacturing failure may have occurred.

In U.S. Pat. No. 4,449,638 issued May 22, 1984 for "Tamper-Resistant And Child-Resistant Closure And Container Assembly", Davis describes a container which has a mouth and a rim around the mouth. A cut-out is provided in the rim and in an annular closure below the rim to close the mouth of the container. A plug enters the mouth of the container to prevent access by children and a tear strip is provided. The patent indicates that if the plastic tear strip is in place, tampering has not occurred. This clearly is not the case as has been pointed out above. Pressure by the thumb, when the cap is aligned properly, permits access to the container and constitutes the child-proof feature of the container.

Koontz, et al in their U.S. Pat. No. 3,850,330 issued Nov. 26, 1974 for "Composite Closure Cap" describe a composite plastic and metal cap for containers, especially glass tumblers or the like. The cap has an outer plastic ring which engages the container and includes a central, disc-like metal cover. Lugs on the skirt of the cap snap over beads on the container rim to provide a seal, and the patentees disclose that vacuum containers may be closed using the cap. The patent focuses on means for making it easier to break the vacuum seal to allow easier removal of the lid. One system includes providing a vent and a penetrator. In one embodiment, the penetrator is arranged on bridge members so that when the bridge members are lifted upwardly the vent is opened. In another embodiment, a plastic ring attached to the plastic side portion is provided for lifting up the side portion and breaking the vacuum seal. The patent does not describe child-proof lids and does not mention a system for warning a consumer if the package has been tampered with or if a manufacturing or packaging failure has occurred. The vent hole in the preferred embodiment is defined by a circular score line which does not penetrate through the cover. A small portion of the score line is of lesser depth so that when the circular vent is opened, the punched-out portion of the vent is prevented from dropping inside the package. In many ways this feature is similar to the well known pop-top containers for beverage products. It is known to the present inventor that a system similar to that described in the Koontz patent is presently being used on glass containers for roasted nuts and perhaps other food products. The patent mentions tampering at Column 3, where it is disclosed that if the penetrator is moved to a certain position and the bridge has been ruptured, then a clear indication that someone has tampered with the sealed package will be presented. There is no teaching or suggestion in the patent of using the closure with plastic or metal containers, or of using the system in combination with child-proof devices such as those described above. Moreover, there is no suggestion in the patent that an audible puff of air entering the container occurs when the disc is ruptured.

A packaging system which would be adaptable for a wide variety of uses, which is relatively inexpensive to produce, which would easily combine with child-proof closure devices, which would be utilized for stackable containers, and which would give a clear audible puff of air as an indication to the consumer that tampering or a package manufacturing malfunction or failure has occurred will represent a significant advance in the art.

OBJECTS AND SUMMARY OF THE INVENTION

It is a principal object of the present invention to provide a packaging system which is not tamper-proof, but rather which is designed to provide a warning to the consumer if the package has been tampered with or if a packaging failure has occurred.

Another object of the present invention is to provide a packaging system in which an audible puff of air entering the container is utilized as the consumer warning mechanism.

Yet another object of the present invention is to provide a packaging system satisfying the above objects and further being capable of being combined with any number of the well known child-proof closures known to the art.

A still further object of the present invention is to provide a packaging system which is easy for the consumer to understand and use.

A different object of the present invention is to provide a packaging system which may be utilized with a variety of products, including but not limited to solid and liquid food products, personal hygiene products and pharmaceutical products.

Another object of the present invention is to provide a packaging system which includes the above advantages and provides packages which may be easily stacked one upon the other.

Another object of the present invention is to provide a packaging system which increases the shelf-life of the product contained therein.

Yet another object of the present invention is to provide a packaging system in which noise occurring because of the opening of the package does not interfere with the warning mechanism built into the packaging system.

Another object of the present invention is to provide a packaging system which may reduce both the number of and costs of product recalls if tampering threats are made.

A still further object of the present invention is to provide a packaging system which provides the foregoing advantages and which may not significantly increase the costs of product packaging for a particular product.

How these and other objects of the present invention are accomplished will be described in the following detailed description of the preferred and several alternate embodiments, taken in conjunction with the Figures. Generally, however, they are accomplished in a packaging system which includes a container for a product and means for opening the container to provide access to the inside thereof. An aperture of small diameter is provided in the container, along with a "seal" for the aperture. A vacuum is provided within the container, the vacuum being sufficient to produce an audible puff of air when the seal is removed from the aperture. The seal removal may be part of the container opening system or separate therefrom, but in any event it is designed to minimize sounds which would interfere with the consumer's ability to detect the puff of air. It is also within the scope of the present invention to provide pressure within the container holding the product, in which case the puff would be created by air flowing into the container or other gaseous media flowing from the container when the seal is removed. In the preferred embodiment, a child-proof closure is also provided with the container. In alternate embodiments of the invention an inner liner or double container are used. Other ways in which the above objects are accomplished will appear to those skilled in the art after the present specification has been read and understood.

DESCRIPTION OF THE DRAWING

Like reference numerals will be used in the various drawings to show like components.

DETAILED DESCRIPTION OF THE PREFERRED AND ALTERNATE EMBODIMENTS

Figure 1:
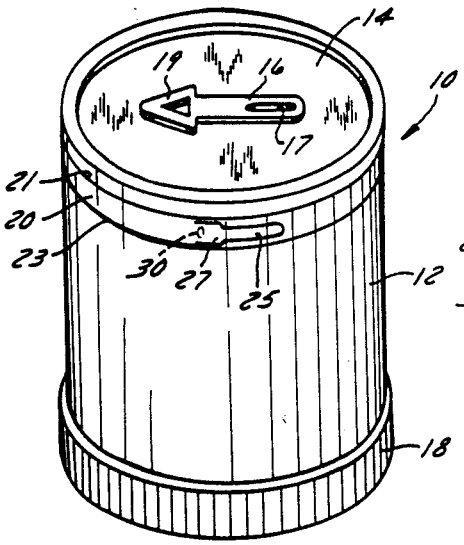
FIG. 1 is a perspective view of a package according to a preferred embodiment of the present invention, showing a key for opening the package affixed to the top of the container and a closure lid for the container attached to the bottom thereof.

Before proceeding to a description of the preferred and alternate embodiments, several comments need to be made concerning the scope of the present invention.

First, with regard to the shape of the package, a generally cylindrical package is shown in most of the drawing, but the principals of the present invention are equally applicable to a wide variety of package shapes. Since one of the requirements of the present invention is that a vacuum or a pressurized gaseous media be provided in the container, the shape must necessarily be able to withstand the vacuum or pressure in all environments to which the package may be exposed. For example, if a vacuum is employed, the container must be able to withstand the vacuum at a wide range of temperatures, as well as a wide range of altitudes. Similarly, if pressure is employed, the same criteria must be considered in designing the package. Examples of other shapes of containers which could employ the principals of the present invention are too numerous to illustrate, but many of the package shapes currently being employed for medical products and liquid or solid food products and personal hygiene products could be employed.

Second, a number of materials can be used to construct the container and some of the criteria mentioned in the preceeding paragraph would apply to material selection as well. The material could be, for example, metal, plastic, glass, etc. It is necessary however, that the material be impervious to the passage of gas under pressure or vacuum so that the warning features to be described later will be present, even if a lengthy period of time passes between packaging of the product and opening of the package by the consumer.

Third, the drawings depict several different methods of opening an aperture in the package, and those skilled in the art will readily appreciate that other opening systems can be employed after the principles of the present invention have been read and understood.

Fourth, it should be appreciated that the package system of the present invention can be employed with or without child-proof lids and that the lids shown are for purposes of illustration and are not to be taken as limiting. As with the shape, material selection and opening mechanisms, one skilled in the art could readily adapt any of a wide variety of child-proof closures for use with the packaging system of the present invention.

Fifth, the present invention was initially conceived for use in the packaging of pharmaceutical products, but the package system is adaptable for use with a wide variety of other products, including food products or any other type of product which could result in injury to the consumer if the contents of the package are tampered with or if a package manufacturing failure has occurred.

Proceeding now to a description of the preferred and an alternate embodiment of the present invention, FIG. 1 shows a package 10 which includes a generally cylindrical body 12, a circular top 14 having a key 16 removably attached thereto. Key 16 includes a slot 17 and a handle portion 19. Container 10 also includes a removable lid 18 which is releasably placed over the bottom of container 10 in the as sold condition (it could also be removably snapped over the top 14 if desired).

The package shown in FIGS. 1–4, is metal and the lid 18 is made from a deformable plastic. Package 10 also includes a tear strip 20 formed by a pair of score lines 21 and 23 encircling body 12 adjacent to top 14. Tear strip 20 includes a tab 25 which is thinner than the remainder of tear strip 20 and which is not physically attached to container 10. A sealing portion 27 is provided between tab 25 and the body of tear strip 20, the purpose of which will become apparent shortly.

Figure 2:
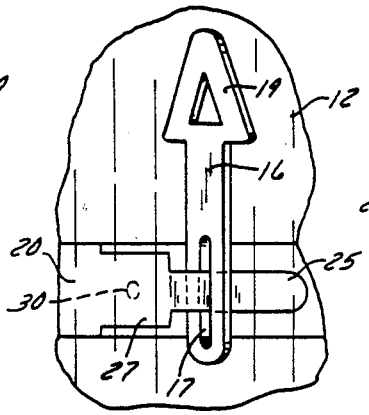
FIG. 2 is an enlarged view showing how the key of the package shown in FIG. 1 is used to begin opening of the package.
Figure 3:
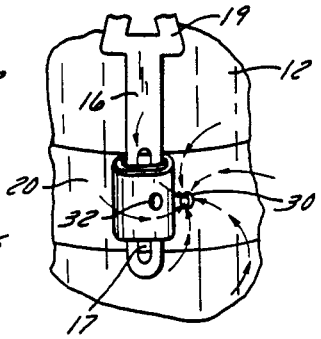
FIG. 3 is a view similar to FIG. 2 but showing the key after revolution and illustrating the opening of an aperture in the package.

Shown in dotted line in FIG. 1, and shown more clearly in the enlarged FIGS. 2 and 3, an aperture 30 is provided in body 12 below sealing member 27, which aperture is closed by a closure means 32 (as best illustrated in FIG. 3). In this embodiment, the closure means comprises solder which seals aperture 30 in FIGS. 1 and 2. As the key 16 is rotated, the tab 25 will initially be wound around the key and eventually the key will reach the area of sealing portion 27. As the key is rotated further, the key will pull the solder 32 from aperture 30 as sealing portion 27 is wound around the coil forming on key 16. As will then be apparent, key 16 is wound further to remove the tear strip from the entire circumference of container 10, thus allowing removal of top 14.

After the top is opened, lid 18 may be removed from container 10 and used as the closure in place of the discarded top 14.

The packaging system illustrated in FIGS. 1–4 is unique in that a vacuum is provided within package 10, the amount of vacuum being sufficient to create an audible puff of air sound as air enters container 10 through aperture 30 as the solder 32 is removed therefrom. FIGS. 2 and 3 are not to scale and a preferred size for aperture 30 is approximately 1/32 inch, although the size may vary depending upon the size and shape of the container, the materials selected for the container and other factors. What is critical is that the audible puff of air be of a sound volume which is significantly greater than the sounds created by the opening of the package itself, so that the consumer will be able to notice the puff of air and determine by its presence or absence whether or not tampering of the product has occured by access through the package or whether a packaging failure has taken place prior to the time the package is opened.

If pressure, instead of a vacuum is employed, the same criteria would be applicable. That is, the pressure and the size of the aperture must be selected so that a sufficiently loud puff of air occurs when the solder is removed.

Figure 9:
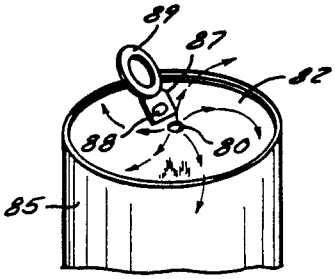
FIG. 9 is a perspective view of another embodiment of the invention, in which the forewarning system is separate from any package opening system.

Obviously, the length of tab 25 and the shape of sealing portion 27 are not critical to the present invention, nor is the use of solder as a sealing device for the aperture. Any system can be used which seals the aperture against the intrusion of air (if vacuum is used) or the escape of air (if pressure is used) over extended periods of time. For example, the sealing portion 27 could be adhesively bonded to container body 12. It should also be mentioned that the shape of aperture 30, while illustrated as being circular, is not critical and that depending on a particular package, other shapes could be employed for accentuation of the puff sound or for manufacturing convenience. It should also be appreciated that the sealing member and the aperture could be separate entirely from the package opening system. For example, an aperture 80 could be located through the top 82 of a can 85 and be sealed by a sealing portion 87 having a pull ring 89 attached thereto. In this case the solder 88 would be removed by pulling on the pull ring 89 allowing air to escape can 85. The can itself would then be opened by any conventional means, such as a can opener. In FIG. 9 the pressure concept is employed, but vacuum could also be used, in which case the air would rush into the can to generate the audible puff of air.

Figure 4:
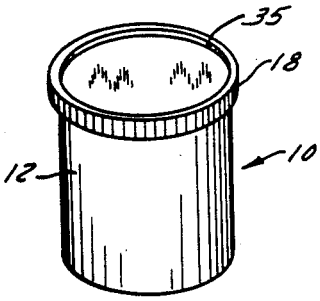
FIG. 4 is a perspective view of the package shown in FIG. 1, with the top removed and the lid moved from the bottom to the top of the package.

It will also be noted from an examination of FIG. 4 that rim 35 is provided on lid 18 sized to receive top 14, so that a number of packages 10 could be stacked easily one upon another. It should also be mentioned in connection with these FIGURES that any type of known child-proof cap could be substituted for the sample lid 18 shown in these FIGURES. While one such closure is shown in the remaining FIGURES, package 10 could include those components typically found on child-proof container bodies and lid 18 could include those components typically found in child-proof closures to interact therewith. For illustration purposes, I have choosen to illustrate the child-proof closure with an alternate embodiment, fully recognizing the applicability of the concept to the aperture sealing and opening technique illustrated in FIGS. 1–4.

The application of the vacuum or the injection of a pressurized gaseous media into package 10 can be accomplished in a variety of ways and using a variety of machinery. In the illustrated embodiment, the vacuum would be created by simply withdrawing air from package 10 through aperture 30 and sealing off the vacuum with a drop of solder 32. Pressurized gas could be added in the same way. While it is much preferred to use vacuum, there could be circumstances where pressurized containers would be beneficial, e.g. in high altitude locations where the altitide could effect the ability of a consumer to hear the puff of air sound as aperture 30 is being opened.

Figure 5:
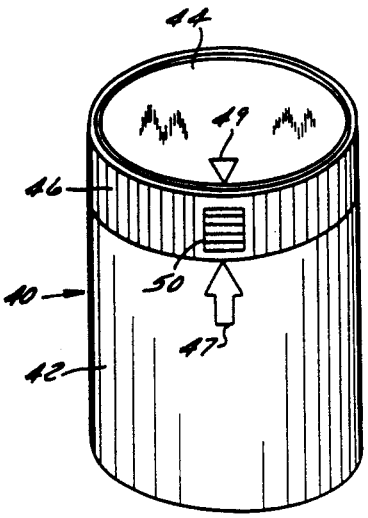
FIG. 5 is a perspective view of a package according to an alternate embodiment of the present invention showing a child-proof closure aligned to allow opening of the package.

A second embodiment of the invention is shown in FIGS. 5–8. FIG. 5 illustrates a package 40 having a cylindrical body 42, a child-proof lid 44 having a depending skirt portion 46. Arrows 47 and 49 are printed or formed respectively on the body 42 and lid 44, which arrows must be aligned to permit opening of the package 40.

The depending skirt portion 46 also includes a ribbed panel 50 to facilitate removal of the lid using thumb pressure when the arrows are properly aligned.

Figure 6:
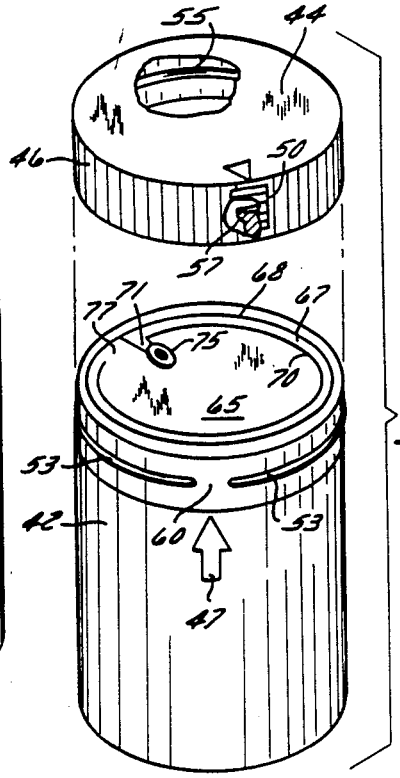
FIG. 6 is a perspective view of the package shown in FIG. 5 with parts broken, away and showing the closure removed from the body of the package.

The particular type of child-proof closure used in this embodiment can best be appreciated from FIG. 6 where it is shown that the body 42 includes a bead 53 which extends around body 42, generally adjacent to but spaced below its top. Cap 44 includes a similar bead 55 on the inner surface of skirt 46, beads 53 and 55 being arranged in such a manner that bead 55 must be pushed over bead 53 to lock lid 44 onto body 42. It will also be appreciated from FIG. 6 that panel 50 includes an inner lug 57 which is adapted to slide between a gap 60 in bead 53 when the arrows are properly aligned.

No claim is made that the child-proof closure shown and described to this point is unique, in and of itself.

However, once the lid is removed, the warning system of the present invention becomes accessible and a second embodiment of such system will now be described.

Figure 8:
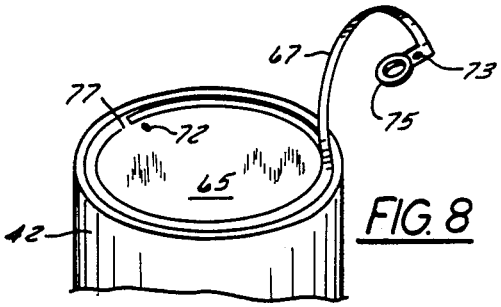
FIG. 8 is a view of the package shown in FIGS. 5–7 and illustrating partial removal of the tear strip.
Figure 7:
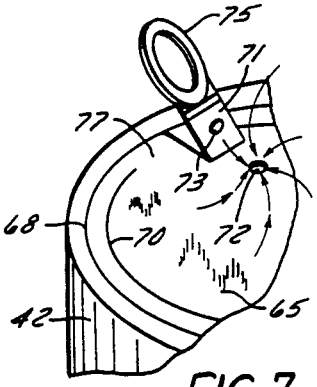
FIG. 7 is an enlarged perspective view showing an aperture in a disc closure of the package shown in FIG. 5 and a sealing member removed therefrom.

Initially sealing container 42 is a disc like metal top 65 which is removed by removing a tear strip 67 encircling top 65. Tear strip 67 is formed by an outer score line 68 and an inner score line 70, the tear strip being attached ultimately to a pull ring 75. Located intermediate the tear strip 67 and pull ring 75 is a sealing portion 71 having a piece of solder 73 attached thereto as is best illustrated in FIG. 7. An aperture 72 is provided in top 65 below sealing portion 71 and sealed in the as-sold condition by the solder 73. In FIG. 8, I have shown the partial removal of the tear strip 67 and also a gap 77 in inner score line 70, such that upon complete removal of the tear strip, top 65 will be lifted away from body 42 for disposal.

In operation and in design of the aperture and sealing portions, the embodiment shown in FIGS. 5–8 is similar in all respects to that shown in FIGS. 1–4. In fact, the two embodiments show the wide variety of uses to which the present invention may be put and the ways in which the objects of the invention may be accomplished. For example, the key operated tear strip could be used in the alternate embodiment, and the child-proof closure 44 could be used with package 10.

Once top 65 has been removed and the customer is satisfied that the packaging of the product has not been tampered with or that packaging failures have not occurred, top 44 is replaced over body 42 and rotated to prevent access to the contents of the package by children. Access to the contents is made possible by aligning the arrows and pushing upwardly on rib panel 50.

With reference now to FIGS. 10–15, inclusive, alternate embodiments of packaging systems falling within the scope of this invention are described. The essential difference between the embodiments of FIGS. 1–9, inclusive, and these embodiments occurs in the provision of a vacuum or pressurized gas zone surrounding a container for the particular product.

Figure 14:
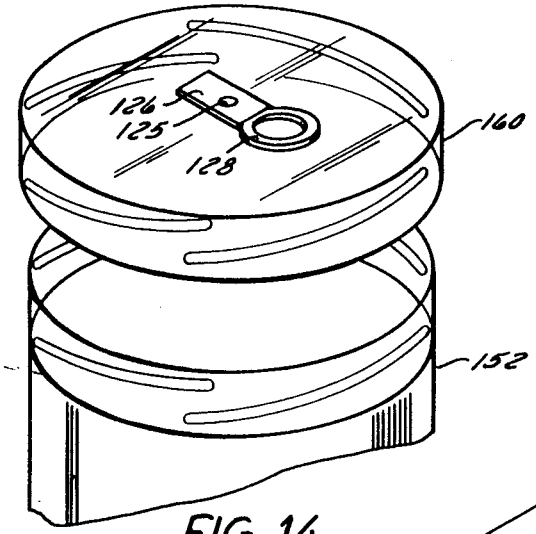
FIG. 14 is an exploded partial view of the embodiment illustrated in FIG. 13, with the screw on lid removed.
Figure 15:
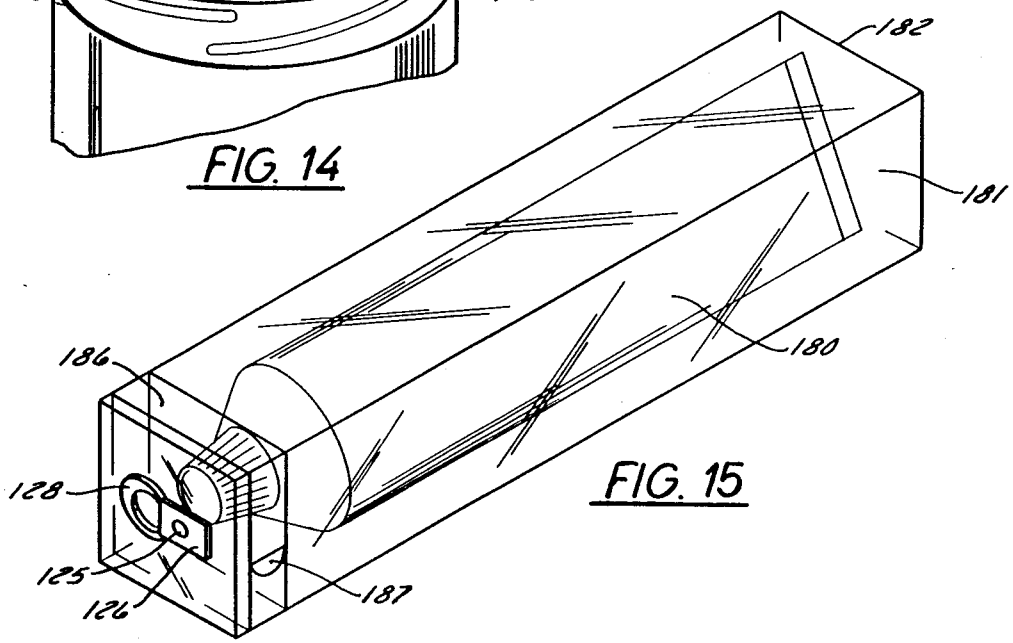
FIG. 15 is a perspective view of still another embodiment of a double container packaging system showing the outer container as a substitute for a conventional folding carton, in this case the system for opening the packaging being a tear strip.
Figure 13:
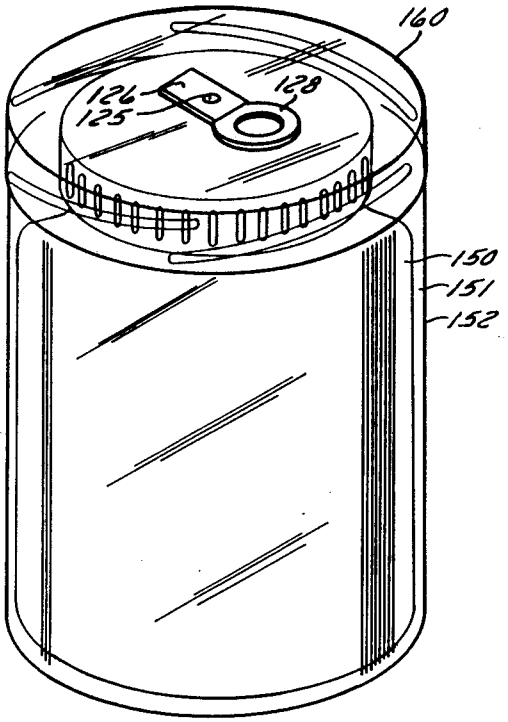
FIG. 13 is a perspective view of a further alternate embodiment of the present invention illustrating a double container packaging system in which a gas or pressure-impervious outer container is used to surround conventional packaging, the outer container including a screw-on lid.

The product container may be selected from many different configurations and materials, three of which are illustrated in this new set of Figures. It will also become apparent that there are really two different ways in which the principles of the present invention may be incorporated for such products: one in which an inner container is constructed specifically for use in the consumer warning system of the present invention and is surrounded and spaced apart from an outer container (FIGS. 10–12); and in the other where conventional packaging may be employed with a separate outer container spaced apart therefrom as is illustrated in FIGS. 13–15.

Before proceeding to a detailed description of these Figures, it must again be pointed out that a wide number of variations are possible for container sizing, opening methods, material selection, etc. The proper parameters and materials can readily be developed by those skilled in the packaging of a particular product once the principles of the present invention have been read and understood. For example, a rib closure system is illustrated for the container of FIG. 10, while a screw-on lid systems is illustrated for the container in FIG. 13. These could be interchanged, or either could be substituted for the tear strip shown in FIG. 15. Similarly, the tear strip could be used in any of the other embodiments.

While polyethylene terephthalate is a preferred material for use for the outer container, other plastics, glass or metal, or any other gas impervious material could be used depending upon the particular application involved. Clear materials are especially preferred for the embodiments shown in this latter group of Figures because the existing labeling of the particular product (whether it be a beverage, peanut butter, toothpaste or the like) can be seen through the outer container, thereby eliminating the need for any type of outer wrappers, such as a folding carton or additional labeling. The elimination of such additional packaging materials could substantially offset the increase in packaging costs associated with utilization of the present invention. However, as previously indicated, public welfare requires the safe packaging of products, and the materials mentioned herein are relatively inexpensive packaging materials which have been used, by themselves, for many years.

Furthermore, while each of the inventions disclosed in FIGS. 10–15 will be described with reference to vacuum systems, it should be understood that pressure could be used in place of the vacuum to create the audible puff when the aperture opening system is activated.

Figures 10, 11, 12:
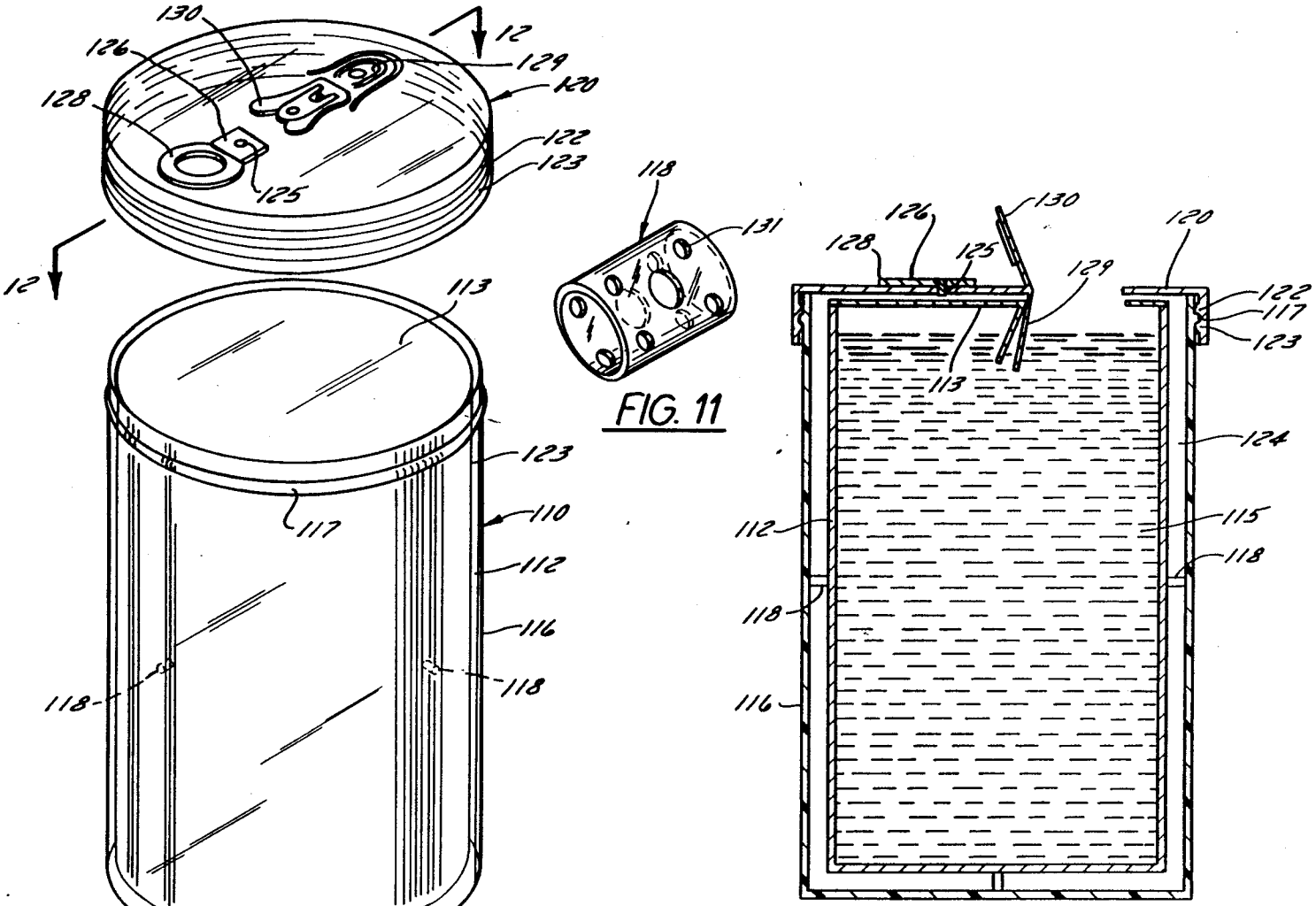
FIG. 10 is a perspective exploded view of another alternate embodiment of the present invention illustrating an inner liner package having a snap-on lid.
FIG. 11 is an enlarged view detailing a supporting peg for separating the inner liner from the outer package shown in FIG. 10.
FIG. 12 is a vertical sectional view taken along lines 12—12 of FIG. 10 and showing one method of piercing the inner liner of the package to allow access to the product contained therein.

The embodiment shown in FIG. 10 illustrates a packaging system 110 which includes a generally cylindrical inner liner 112 which may be used to contain solid or liquid products, such as carbonated or uncarbonated beverages. A foil seal 113 is provided across the open mouth of cylinder 112 to completely containerize the particular product, in this case a liquid 115 (see FIG. 12).

Spaced apart a small distance from and surrounding container 112 is an outer container 116, which in the preferred embodiment is made from polythylene terephthalate or PET. Spaced below the top of outer container 116 and surrounding its circumference is an annular rib 117 and to support container 112 within container 116, a plurality of plugs 118 are used and are best shown in FIGS. 11 and 12. The plugs will be described later.

The closure for outer container 116 comprises a cap 120 having a diameter slightly exceeding that of container 116 and having a pair of inner ribs 122 and 123 designed to cooperate with rib 117 on container 116 to form a vacuum seal when a vacuum is provided in the space 123 between containers 112 and 116. This snap-on concept is known to the art and, in and of itself, is not deemed to be within the scope of the present invention.

On cap 120 are located the vacuum release system previously disclosed including an aperture 125, an aperture sealing member 126 and an aperture sealing member removing ring 128. Also located on cap 120 is a container opening and puncturing system designed like common beverage cans to force a piece of metal 129 downwardly when a pull tab 130 is lifted upwardly. As illustrated best in FIG. 12, the lifting of the pull tab 130 forces the piece of metal downwardly and through the foil seal 113 to permit the product to be poured from the inner container 112. In operation, before opening the container, the consumer would lift pull ring 128 and listen for the audible puff of air entering the space 123. Once satisfied that the vacuum was present, the foil opening system is then used to gain access to the liquid 115.

A blown up drawing of one particular configuration for plugs 118 is provided in FIG. 11 where it is shown that the plug is preferably hollow and various apertures 131 are provided around its periphery. This particular plug design is preferred in that it would prevent anyone wishing to tamper with the product from inserting a hypodermic needle through the plug and hence through the vacuum zone 123 into the liquid 115.

FIG. 13 shows yet another embodiment where a conventional package, in this case a jar of peanut butter 150 is surrounded by an outer container 152 creating a space 151 therebetween. Vacuum is provided in this space to provide the warning audible puff of air as will be later explained. In this case, outer container 152 is an open mouth container having threads thereon and designed to cooperate with a cap 160 which includes the vacuum release mechanism as previously described with respect to the embodiment of FIG. 10. In this embodiment, the conventional packaging for the peanut butter is used, and the only packaging process required is to draw a vacuum between the original peanut butter jar and outer container 152 followed by screwing on the cap 160 while the vacuum is maintained. FIG. 14 illustrates the cap before it has been screwed onto outer container 152. Pulling the pull ring 128 of the vacuum release system will alert the consumer whether the vacuum has been released. While a small airspace is shown in this drawing, only a small airspace is required to create the audible puff of air required by the present invention. In this embodiment, pegs may or may not be used, and are not shown here because it is not, in this embodiment, required to maintain the product in a fixed location within the outer container 152.

Another embodiment of the invention is shown in FIG. 15 where a common tube of toothpaste 180 is shown contained within and outer package 182 made of a clear plastic material. The vacuum release system is shown on one end of the tube which is generally square in cross section. A different outer container opening system, however, is provided in this embodiment, in that a tear strip 186 having a pull tab 187 is employed as part of outer container 182. The space 181 between the tube and outer container 182 is sufficient in volume to create the audible warning puff of air described previously. In operation, the consumer would first operate the audible vacuum air puff system, and if satisfied that the vacuum has not been released, would then lift the tab 187 and pull strip 186 to tear away a portion of the outer container and gain access to the toothpaste tube.

The embodiments shown in FIGS. 13 and 15 describe only two of the many pharmaceutical, food, beverage or personal hygiene products with which the present invention may be used. Obviously, the shape of the outer container will depend greatly upon the type of product to be contained in the inner container which actually surrounds or packages the product in question.

At this point of the description of the invention the inventor would again like to point out that he believes too much emphasis has been placed on tamper-resistant closers, such as foil seals, shrink wraps and the like, when, in fact, most plastic, glass and metal containers on the market today can be penetrated and the product contaminated without removing the closure. Therefore in some cases the manufacturer may eliminate these presently used and practically useless tamper-resistant closures and, together with the use of transparent outer containers, help reduce or offset the cost of the packaging systems described and claimed herein. FIG. 15, provides an excellent example of how the use of a clear plastic outer container could eliminate the need for the folding carton presently used for the sale of most toothpaste products. Additionally, the carton and printing costs of such cartons would be totally eliminated and would be a direct offset to the outer container and vacuum sealing equipment costs required for producing packages embodying the present invention.

While the present invention has been described in connection with general illustrated embodiments, the invention is not to be limited thereby but is to be limited solely by the scope of the claims which follow. Those claims should be read in the context of the general observations made at the beginning of this section of the specification and the comments on readily apparent variations to the illustrated embodiments which have been specifically discussed. The claims should also be read in the context of what will readily become apparent to those skilled in the art after the present specification has been read and understood.

What is claimed is:

1. A package for containing a product comprising:
an inner container for holding a product within the package;
an outer container of gas-impervious material surrounding and spaced apart from said inner container whereby a space is defined between said inner and outer containers;
a vacuum within said space;
an aperture in said outer container extending through the surface of said outer container to communicate with said space;
means sealing said aperture, whereby the vacuum is maintained in said space; and
means for removing said sealing means from said aperture to produce an audible signal or puff of air entering said space through said aperture and wherein spacer means are located within said space to ensure a spacial relationship between said inner and outer container.

2. The package of claim 1, wherein the spacer means is in the form of a hollow peg transversely apertured.

3. The package of claim 1, wherein said outer container is transparent to permit visual inspection of the surface of said inner container.

4. A package for containing a product comprising:
an inner container for holding a product within the package;
an outer container of gas-impervious material surrounding and spaced apart from said inner container whereby a space is defined between said inner and outer containers;
a pressurized gas within said space;
an aperture in said outer container extending through the surface of said outer container to communicate with said space;
means sealing said aperture, whereby gas pressure is maintained in said space; and
means for removing said sealing means from said aperture to produce an audible signal or puff of gas escaping from said space through said aperture and wherein spacer means are located within said space to ensure a spacial relationship between said inner and outer container.

5. The package of claim 4, wherein the spacer means is in the form of a hollow peg transversely apertured.

6. The package of claim 4, wherein said outer container comprises a body portion and a lid portion and means for coupling said portion and for permitting said outer container to be opened to gain access to said inner container.

7. The package of claim 6 wherein said coupling means is selected from the group of coupling means comprising screw-on lids, snap-on lids, or lids separable from said body portion by a tear strip.

* * * * *